United States Patent [19]

Kuehler

[11] 4,381,987

[45] May 3, 1983

[54] HYDROPROCESSING CARBONACEOUS FEEDSTOCKS CONTAINING ASPHALTENES

[75] Inventor: Christopher W. Kuehler, Larkspur, Calif.

[73] Assignee: Chevron Research Company, San Francisco, Calif.

[21] Appl. No.: 278,796

[22] Filed: Jun. 29, 1981

[51] Int. Cl.[3] ..... C10G 1/06

[52] U.S. Cl. ..... 208/10

[58] Field of Search ..... 208/10, DIG. 1

[56] References Cited

U.S. PATENT DOCUMENTS

| | | | |
|---|---|---|---|
| 3,718,577 | 2/1973 | Nai et al. | 208/DIG. 1 |
| 4,018,663 | 4/1977 | Karr, Jr. | 208/10 |
| 4,054,504 | 10/1977 | Chervenak et al. | 208/10 |
| 4,081,360 | 3/1978 | Tan et al. | 208/8 LE |
| 4,108,758 | 8/1978 | Schoennagel et al. | 208/8 LE |
| 4,236,219 | 11/1980 | Killebrew, Jr. et al. | 208/DIG. 1 X |
| 4,255,248 | 3/1981 | Rosenthal et al. | 208/10 X |
| 4,264,429 | 4/1981 | Rosenthal et al. | 208/10 |
| 4,338,183 | 7/1982 | Gatsis | 208/10 |

*Primary Examiner*—Delbert E. Gantz
*Assistant Examiner*—William G. Wright
*Attorney, Agent, or Firm*—D. A. Newell; S. R. La Paglia; S. H. Roth

[57] ABSTRACT

A liquid hydrocarbonaceous feedstock containing asphaltenes and optionally solids is hydroprocessed by passing the feedstock through a catalytic reaction zone in the presence of a catalyst bed containing a solid hydroprocessing catalyst under hydroprocessing conditions to produce a hydrocarbonaceous effluent containing solids. Plugging of the catalyst bed is avoided by controlling the severity of the hydroprocessing conditions in the catalytic reaction zone to maintain the aliphatic hydrogen concentration of the liquid effluent sufficiently low to prevent substantial precipitation of asphaltenes within the catalytic reaction zone.

18 Claims, No Drawings

HYDROPROCESSING CARBONACEOUS FEEDSTOCKS CONTAINING ASPHALTENES

BACKGROUND OF THE INVENTION

The present invention relates to hydroprocessing of heavy hydrocarbonaceous materials. More particularly, the invention involves the hydroprocessing of hydrocarbonaceous liquids containing n-heptane-insoluble asphaltenes.

The presence of n-heptane-insoluble asphaltenes in heavy oils such as coal derived oils, shale oil, oil derived from tar sands, and heavy petroleum or petroleum fractions has long been recognized as a complication in hydroprocessing. The large effective diameter of asphaltene molecules, typically 100 to 600 Angstroms, does not permit their entry into the pores of many commercial hydroprocessing catalysts. Conversion of asphaltenes during catalytic hydroprocessing has therefore required the development of special large-pore catalysts. Such catalysts, however, tend to have lower surface areas than conventional hydroprocessing catalysts and therefore tend to be less active. As a result many commercial hydroprocessing units have not been effective for totally converting asphaltenes. The presence of asphaltenes is particularly bothersome in feedstocks containing significant amounts of solids, such as liquids derived from coal, oil shale, tar sands, gilsonite or other solid carbonaceous materials.

Various techniques have been employed for the removal of asphaltenes from heavy hydrocarbons including solvent deasphalting and catalytic hydrogenative deasphalting. Other approaches have focused upon suppressing the formation of asphaltenes. See, for example, U.S. Pat. No. 4,081,360, issued Mar. 28, 1978 to Tan et al where light solvents are added to coal liquefaction fractions.

SUMMARY OF THE INVENTION

It is an object of the invention to provide a method for the catalytic hydroprocessing of hydrocarbonaceous feedstocks containing asphaltenes. Another object is to provide a method for hydroprocessing feedstocks which also contain significant amounts of suspended solids.

It is a further object to provide a process which can be carried out in packed bed catalytic reactors of conventional design with conventional hydroprocessing catalysts.

These and other objects are achieved according to this invention in a process for avoiding catalyst plugging during the hydroprocessing of a liquid hydrocarbonaceous feedstock containing n-heptane-insoluble asphaltenes comprising the steps of (a) passing said hydrocarbonaceous feedstock through a catalytic reaction zone in the presence of a packed bed containing solid hydroprocessing catalyst under hydroprocessing conditions to produce a hydrocarbonaceous liquid effluent and (b) controlling the severity of the hydroprocessing conditions in said catalytic reaction zone to maintain the aliphatic hydrogen concentration of said hydrocarbonaceous liquid effluent sufficiently low to prevent substantial precipitation of n-heptane-insoluble asphaltenes within said catalytic reaction zone. When solids are present in the feed, an upflow reactor is strongly preferred. All or substantially all of the hydrocarbonaceous feedstock to the catalytic reaction zone can pass upwardly through the catalyst bed. If desired, the process can be monitored periodically or continuously to provide parameters for controlling the severity; for example by measuring the content of n-heptane insoluble asphaltenes, by measuring the aliphatic hydrogen concentration of the effluent or by measuring properties which are correlatable to the aliphatic hydrogen concentration, such as the hydrogen/carbon atomic ratio, the density or the viscosity of the hydroprocessed effluent. For purposes of this invention the terms "asphaltenes" and "n-heptane-insoluble asphaltenes" are synonymous, and used interchangeably to denote asphaltenes insoluble in hot n-heptane, boiling at atmospheric pressure.

DETAILED DESCRIPTION OF THE INVENTION

According to this invention the conditions of a packed bed catalytic hydroprocessing stage are controlled in order to avoid the substantial precipitation of asphaltenes within the catalyst bed. By suppressing the asphaltene precipitation, the formation of asphaltene-containing agglomerates can be avoided, reducing the tendency for plugging. The avoidance of asphaltene precipitation is particularly important when the feed contains suspended solids.

Asphaltene precipitation is avoided according to this invention by controlling the reaction conditions to avoid excess hydrogenation of the liquid phase within the reactor. By maintaining the aliphatic hydrogen concentration of the hydroprocessed liquid effluent sufficiently low, the solubility of the liquid for asphaltenes can be maintained sufficiently high to avoid substantial asphaltene precipitation. "Substantial asphaltene precipitation" is defined as sufficient precipitation to cause unacceptable pressure drops due to the formation of plugs within the system, for example, axially localized concentrations of 20% by weight or more of precipitated asphaltenes. As a general rule, asphaltene precipitation plugs tend to form first in the downstream regions of the catalytic bed.

Feedstocks suitable for use in the process of this invention include any hydrocarbonaceous liquid which contains asphaltenes [about 0.05 weight percent or 0.5 or 1—up to 90 weight percent and optionally also suspended solids (about 0.5 weight percent or more, for example, 2–10 weight percent]. Examples of suitable feedstocks include crude petroleum oils atmospheric or vacuum residua, topped crudes, reduced crudes or fractions thereof which can also contain suspended matter such as added catalysts or contact materials. Also included are coal/solvent or coal/petroleum mixtures; coal-derived liquids containing suspended coal-derived solids, such as ash, e.g., hydrocarbonaceous liquids derived from bituminous, sub-bituminous or brown coals or lignite; hydrocarbonaceous liquids derived from oil shale, e.g., retorted shale oil; and hydrocarbonaceous liquids derived from other mineral sources such as tar sands, gilsonite, etc. The feed to the catalytic reactor can contain any type of solids, including very fine particles less than 5 micrometers in diameter, such as oil shale fines, catalyst fines or coal ash. The feed can be the effluent from upstream processing steps, for example from a first stage coal dissolution zone where coal is dissolved in a coal-derived recycle solvent or a petroleum or petroleum-derived solvent with or without added catalysts. The effluent slurry contains solvent, dissolved coal and coal-derived solids such as ash and undissolved coal. Preferred coal liquefaction processes for application of the process of the invention are disclosed in U.S. Pat. No. 4,264,429 to Rosenthal et al for "Two-Stage Coal Liquefaction Process With Process-Derived Solvent" and U.S. Pat. No. 4,255,248 to Rosenthal et al for "Two-Stage Coal Liquefaction Process With Process-Derived Solvent Having A Low Heptane-Insolubles Content" which are incorporated herein by reference.

The catalytic reaction zone according to this invention can be any configuration of packed bed such as gravity packed beds, including moving beds, fixed beds, and beds which move periodically to provide for partial catalyst replacement. The feed can be passed upwardly or downwardly through the packed bed. When solids are present in the feed, it is much preferred that the feed be passed upwardly through the bed. Preferably all or substantially all of the feed to the catalytic reaction zone is passed upwardly through the bed. The principles of asphaltene precipitation control are also applicable to expanded, fluidized, or ebullated beds, where plugging is not a serious problem.

A wide variety of hydroprocessing catalysts are suitable for use according to this invention. Examples of such catalysts include catalysts having one or more elements from Group VI-B or Group VIII of the Periodic Table of the Elements (Handbook of Chemistry and Physics, 45th Edition, Chemical Rubber Co.) supported on inorganic supports such as alumina, silica, magnesia, boria, zirconia, titania, clays, including attapulgite, sepiolite, halloysite, kaolinite, imogololite, palygorskite, etc., or mixtures thereof. Any commercial catalyst which is suitable for hydroprocessing the feedstock is suitable for use in the process of this invention. The catalyst bed can contain other said materials such as inexpensive guard catalysts or substantially noncatalytic contact materials, etc.

This invention contemplates the variation of the hydroprocessing conditions within wide ranges in order to achieve the desired conversion while maintaining the aliphatic hydrogen content of the liquid product sufficiently low to avoid substantial asphaltene precipitation. As would be expected the suitable hydroprocessing conditions will depend on the type of catalyst used. Catalysts having high hydrogenation or hydrocracking activity such as catalysts supported on silica-alumina or silica-alumina-titania bases will require milder hydroprocessing conditions in the catalytic reaction zone than will alumina-supported catalysts having lower hydrogenation or hydrocracking activity. Hydroprocessing includes hydrodesulfurization, hydrodenitrogenation, hydrocracking, saturation, hydrodemetalation, hydrofining, and other hydrogenations. Contemplated ranges of hydroprocessing conditions are temperatures of 600° to 850° F., preferably 650° to 775° F., pressures from 500 to 5,000 psig, preferably 1,000 to 3,000 psig; hydrogen rates of 2,000 to 20,000 standard cubic feet per barrel, preferably 3,000 to 10,000 standard cubic feet per barrel, and a slurry hourly space velocity in the range of 0.1 to 10, preferably 0.2 to 5 hours$^{-1}$.

The control conditions for any particular feedstock and catalyst system can be readily determined by routine experimentation, with reaction conditions being varied systematically to produce a hydrocarbonaceous liquid product having substantially no precipitated asphaltenes. For example, the hydroprocessing unit can be operated first at a severity which results in asphaltene precipitation within the reactor. The conditions can then be modified to reduce the severity of hydrogenation until substantially no precipitated asphaltenes are present in reactor effluent. The severity can be reduced for example by any of the following modifications singly or in combination: (a) reducing the temperature, (b) reducing the pressure, (c) reducing the hydrogen rate, thereby reducing the hydrogen partial pressure, (d) reducing the residence time, i.e., increasing the space velocity, or (e) substituting a catalyst having a lower hydrogenation or hydrocracking activity.

The maximum permissible aliphatic hydrogen concentration for a particular reaction system will depend upon the temperature of the hydroprocessing zone, the asphaltene concentration and perhaps even on the type of asphaltenes present in the feed to the reactor. The aliphatic hydrogen concentration correlates well to the hydrogen/carbon atomic ratio. For example with coal-derived liquid feeds containing coal-derived solids, a reactor product containing up to about 1% n-heptane insoluble asphaltenes should have a hydrogen/carbon atomic ratio of about 1.6 or lower for operation of the catalytic zone at about 700° F. or higher.

Once the suitable reaction conditions for avoiding asphaltene precipitation have been determined, the process is preferably operated as closely as possible to those conditions in order to obtain close to the maximum permissible hydrogenation of the liquid. Efficient operation of the hydroprocessing unit at or near the severity which asphaltenes begin to precipitate may entail continuous monitoring of the process to adjust for changes in feed conditions, reactants, etc. This monitoring can be done, for example by either continuously or periodically measuring and/or sampling the hydrocarbonaceous liquid effluent from the reactor. It will be apparent that any of a large number of chemical or physical properties can be measured to provide an indication of actual or incipient asphaltene precipitation. Any property or component which can be at least roughly correlated to the aliphatic hydrogen content of the product can be employed as a parameter for controlling the severity of the hydroprocessing conditions. For example, the hydrogen/carbon ratio can be directly measured periodically with an elemental analyzer, or the dissolved or undissolved n-heptane insoluble asphaltene content can be measured to indicate whether the liquid phase is approaching asphaltene saturation at the processing conditions. The viscosity or density, which can be used as correlational parameters to the aliphatic hydrogen content or the H/C ratio, can be measured as well. The aliphatic hydrogen concentration can be directly measured by well-known nuclear magnetic resonance techniques. Aliphatic hydrogen is generally detected in the 0–4 ppm range of the proton NMR, relative to tetramethyl silane, (0).

In reactors containing packed catalyst beds the precipitation of asphaltenes can also be detected by formation of plugs within the catalyst bed, accompanied by a measurable increase in pressure drop across the bed. Hence, the pressure drop across the catalyst bed may also be used as a parameter for controlling the severity. By reducing the severity of the reaction it is contemplated that the hydrogen/carbon ratio can be reduced sufficiently to dissolve localized plugs which have formed, thereby reducing the pressure drop across the catalyst bed. The measurement and control techniques of this invention are adaptable to automatic operation using conventional technology including appropriately alarmed and programmed digital control devices.

The following examples demonstrate the relationship of reactor severity to asphaltene precipitation and are presented only for illustration. Those skilled in the hydroprocessing art can apply the method of this invention to virtually any hydroprocessing system for avoiding substantial asphaltene precipitation within the catalytic bed.

EXAMPLE 1

In a two-stage coal liquefaction run, coal was dissolved in a first stage in the absence of a supported catalyst and the entire product of the first stage was passed to a second stage upflow fixed bed catalytic hydrogenation zone comprising two reactor units in series. The catalyst contained nominally about 8% Ni, 24% W, and 2% Ti as oxides on a support comprising 40% $Al_2O_3$ and 8% $SiO_2$. The feed to the catalytic hydrogenation zone was the product of the first stage dissolution of a mixture of Illinois #6 coals (Burning Star and River King) in a recycle solvent at 825° F. The catalytic zone was operated at a slurry hourly space velocity over the catalyst of one-third $hour^{-1}$ (a residence time of 3 hours) a total pressure of 2400 psig, and a hydrogen gas rate of 10,000 standard cubic feet per barrel of slurry feed. The temperature of the catalytic reactor was increased over a period of 400 hours from 690° F. to 730° F. As a result the atomic hydrogen/carbon ratio of the whole liquid product increased from 1.56 to 1.71, however, the amount of n-heptane-insoluble asphaltenes in the product increased from approximately 0.2% to 1.4%. After 455 run hours, a solid plug was formed at the downstream end of the second catalytic bed where the hydrogen/carbon atomic ratio of the liquid would be expected to be the highest within the system.

EXAMPLE 2

In a two-stage coal liquefaction run similar to Example 1, Burning Star Illinois #6 coal was dissolved in a recycle solvent in a first stage in the absence of a supported catalyst at 835° F., a space velocity of 2 $hours^{-1}$, a total pressure of 2400 psig and a hydrogen rate of 10,000 SCF/bbl of feed. The entire product of the first stage was passed to a second stage upflow fixed bed catalytic hydrogenation zone comprising two reactors in series. The catalyst contained an alumina matrix containing about 8% nickel, 20% molybdenum, 6% titanium, and 2–8% phosphorus. Such a catalyst can be prepared using the general cogellation procedures described in U.S. Pat. No. 3,401,125 to Jaffee, Sept. 10, 1968 for "Coprecipitation Method for Making Multi-Component Catalysts" which is incorporated herein by reference, wherein phosphoric acid is employed as a phosphorus source. The catalytic reactor was operated at about 690° F. and a space velocity of $\frac{1}{3}$-$hour^{-1}$, a total pressure of 2400 psig and a hydrogen rate of 10,000 SCF/bbl. The hydrogen/carbon atomic ratio of the catalytic reactor product was 1.5 and the asphaltene content was 1.6 weight percent. After stable operation without plugging for over 350 hours, the feed coal was switched to Western U.S. subbituminous coal where operation was continued for over 200 additional hours. The run was eventually terminated by a build-up of solids on a support screen beneath the catalyst bed of the second reactor.

It will be recognized by those skilled in the art that asphaltene precipitation within packed bed catalytic hydroprocessing reactors may be avoided by techniques other than those specifically disclosed herein without departing from the spirit and scope of this invention, and such methods are contemplated as equivalents of those disclosed.

I claim:

1. A process for avoiding catalyst bed plugging during the liquefaction of coal comprising the steps of:

(a) passing a slurry comprising a hydrocarbonaceous liquid and particulate coal or coal-derived particles with hydrogen upwardly through a catalytic reaction zone in the presence of a packed bed containing a solid hydroprocessing catalyst under hydroprocessing conditions to produce a hydrocarbonaceous liquid effluent containing insoluble solids; and (b) controlling the severity of the hydroprocessing conditions in said catalytic reaction zone to maintain the aliphatic hydrogen concentration of said hydrocarbonaceous liquid effluent sufficiently low to prevent substantial precipitation of n-heptane insoluble asphaltenes within said catalytic reaction zone.

2. A process according to claim 1 wherein substantially all of the slurry feed to said catalytic reaction zone is passed upwardly through said packed bed.

3. A process according to claim 1 wherein said packed bed is a fixed bed.

4. A process according to claim 3 wherein said packed bed is a moving bed.

5. A process according to claim 1, 2, 3, or 4 further comprising the step of measuring the aliphatic hydrogen concentration of said hydrocarbonaceous liquid effluent to provide a parameter for said controlling step.

6. A process according to claim 1, 2, 3 or 4 further comprising the step of measuring the hydrogen/carbon atomic ratio of said hydrocarbonaceous liquid effluent to provide a parameter for said controlling step.

7. A process according to claim 1, 2, 3, or 4 further comprising the step of measuring the n-heptane-insoluble asphaltene content of said hydrocarbonaceous liquid effluent to provide a parameter for said controlling step.

8. A process according to claim 1, 2, 3, or 4 further comprising the step of measuring the density of said hydrocarbonaceous liquid effluent to provide a parameter for said controlling step.

9. A process of claim 1, 2, 3, or 4 further comprising the step of measuring the viscosity of said hydrocarbonaceous liquid effluent to provide a parameter for said controlling step.

10. A process for avoiding catalyst bed plugging during the liquefaction of coal and the hydroprocessing of a heavy petroleum oil comprising the steps of:

(a) passing a carbonaceous slurry comprising (1) heavy petroleum or heavy petroleum derived-oil, and (2) particulate coal or coal-derived particles with hydrogen upwardly through a catalytic reaction zone in the presence of a packed bed containing a solid hydroprocessing catalyst under hydroprocessing conditions to produce a hydrocarbonaceous liquid effluent containing insoluble solids; and (b) controlling the severity of the hydroprocessing conditions in said catalytic reaction zone to maintain the aliphatic hydrogen concentration of said hydrocarbonaceous liquid effluent sufficiently low to prevent substantial precipitation of n-heptane-insoluble asphaltenes within said catalytic hydrogenation zone.

11. A process according to claim 10 wherein substantially all of the carbonaceous slurry feed to said catalytic reaction zone is passed upwardly through said packed bed.

12. A process according to claim 10 wherein said packed bed is a fixed bed.

13. A process according to claim 10 wherein said packed bed is a moving bed.

14. A process according to claim 10, 11, 12, or 13 further comprising the step of measuring the aliphatic hydrogen concentration of said hydrocarbonaceous liquid effluent to provide a parameter for said controlling step.

15. A process according to claim 10, 11, 12, or 13 further comprising the step of measuring the hydrogen/carbon atomic ratio of said hydrocarbonaceous liquid effluent to provide a parameter for said controlling step.

16. A process according to claim 10, 11, 12, or 13 further comprising the step of measuring the n-heptane-insoluble asphaltene content of said hydrocarbonaceous liquid effluent to provide a parameter for said controlling step.

17. A process according to claim 10, 11, 12, or 13 further comprising the step of measuring the density of said hydrocarbonaceous liquid effluent to provide a parameter for said controlling step.

18. A process according to claim 10, 11, 12, or 13 further comprising the step of measuring the viscosity of said hydrocarbonaceous liquid effluent to provide a parameter for said controlling step.

* * * * *